US006532967B1

(12) United States Patent
Dumler

(10) Patent No.: US 6,532,967 B1
(45) Date of Patent: Mar. 18, 2003

(54) MASCARA BRUSH

(75) Inventor: Norbert Dumler, Ansbach (DE)

(73) Assignee: georg karl geka-brush GmbH, Bechhofen-Waizendorf (DE)

( * ) Notice: Subject to any disclaimer, the term of this patent is extended or adjusted under 35 U.S.C. 154(b) by 0 days.

(21) Appl. No.: 09/481,017

(22) Filed: Jan. 11, 2000

(30) Foreign Application Priority Data

Jan. 12, 1999 (DE) ..... 199 00 784

(51) Int. Cl.[7] ..... A45D 40/26; A45D 40/24; A46B 17/08; D46B 11/00

(52) U.S. Cl. ..... 132/218; 132/317; 132/320; 401/126; 401/122

(58) Field of Search ..... 132/218, 313, 132/320, 317; 401/122, 126, 129; 15/160, 167.1, 206

(56) References Cited

U.S. PATENT DOCUMENTS

| | | | | | |
|---|---|---|---|---|---|
| 1,793,768 | A | * | 2/1931 | Anderson | 15/160 |
| 1,806,519 | A | * | 5/1931 | Cave | 15/160 |
| 1,812,626 | A | * | 6/1931 | Edison | 15/160 |
| 4,458,701 | A | * | 7/1984 | Holland | 132/218 |
| 5,067,195 | A | * | 11/1991 | Sussman | 15/167.1 |
| 5,513,410 | A | | 5/1996 | Liu | |
| 5,611,361 | A | | 3/1997 | Leone | |
| 6,003,519 | A | * | 12/1999 | Gueret | 132/218 |
| 6,050,273 | A | * | 4/2000 | Lhuisset | 132/317 |

FOREIGN PATENT DOCUMENTS

| | | |
|---|---|---|
| DE | 42 05 935 | 9/1993 |
| DE | 93 16 704.0 | 2/1994 |
| DE | 44 46 521 | 6/1996 |
| DE | 296 18 479 | 1/1997 |
| DE | 38 35 843 | 5/1997 |
| EP | 0 832 580 | 4/1998 |

* cited by examiner

*Primary Examiner*—John J. Wilson
*Assistant Examiner*—Robyn Kieu Doan
(74) *Attorney, Agent, or Firm*—Browdy and Neimark, P.L.L.C.

(57) ABSTRACT

In a mascara brush comprising a core of intertwisted wire sections, between which a plurality of bristles is fixed in place, standing out from the core, a free end of the core, which is not trimmed with bristles, being joined to a stem, it is provided, with a view to obtaining optimal application properties, that the core has a wavy configuration.

10 Claims, 2 Drawing Sheets

MASCARA BRUSH

BACKGROUND OF THE INVENTION

1. Field of the Invention

The invention relates to a mascara brush comprising a core of intertwisted wire sections, between which a plurality of bristles is fixed in place, standing out from the core, a free end of the core, which is not trimmed with bristles, being joined to a stem.

2. Background Art

Mascara brushes of the generic type serve to transfer mascara from a reservoir onto the user's lashes. It is important for the brushes to possess a good transfer capacity on the one hand and adequate combing and separating properties on the other, when the mascara is applied by means of the brushes.

For the optimization and individualization of the properties of these mascara brushes, it is known to make use of a variety of bristle material or of combinations of various bristles.

Mascara brushes are known from DE 44 46 521 A1, in which the core is bent in the way of an eye.

DE 38 35 843 A1 describes a mascara brush with fibers which can be split by a binding agent being dissolved.

DE 198 47 733 discloses a brush in which the envelope curve of the tips of the bristles on the convex side of the core is approximately in the shape of a segment of an arc of a circle in a longitudinal section and approximately linear at least along a section line on the concave side of the core.

DE 296 18 479 U describes a mascara brush in which the bristles are cut in such a way that seen in a cross-sectional view, they are asymmetric such that the bristles on one side stand further out from the intertwisted wire sections than they do on the other side, and that seen in a longitudinal section, they are also asymmetrically cut to have varying lengths.

A brush is known from DE 93 16 562 U, in which the brush core, which is formed by the intertwisted wire sections, is twisted itself, providing a cylindrical inner cavity.

SUMMARY OF THE INVENTION

It is an object of the invention to embody a mascara brush of novel and attractive design which offers possibilities of application not known so far.

According to the invention, this object is attained by the wire core having a wavy configuration.

On the one hand, when the brush is rotated in the reservoir, this helps produce a distinct stirring effect, which leads to homogenizing and agitating the pigments in the mascara. On the other hand it is achieved that the lashes are contacted by the bristles from various angles during the application and combing process, and that a very uniform application of mascara takes place as a result.

In keeping with a further embodiment of the invention provision can be made for the central longitudinal axis of the wavy configuration to be offset relative to the central longitudinal axis of the stem.

Another advantageous embodiment provides that the bristles on the free end of the brush stand out in the shape of a semicircle on both sides of the central longitudinal axis.

This can be put into practice for instance by the free end of the core being bent backwards in a direction toward the stem.

It can further be provided that the section of the core that is located between the stem and the brush trimming is bent by an acute or obtuse angle or by 90° relative to the longitudinal axis, the longitudinal axis of the trimming itself being parallel to the longitudinal axis of the stem.

The invention relates to a mascara unit comprising a mascara brush of the type specified above and a reservoir for the accommodation of mascara, into which dips the brush.

In such a mascara unit it is advantageously provided that at least part of the bristles of the trimming of the brush, when dipped, contact the inside wall of the reservoir. A stirring and stripping effect can be realized in this way.

The reservoir may have a diameter ranging between 9.0 mm and 18.0 mm and a length of 25 mm to 80 mm.

By advantage it can be provided that the reservoir has a noncircular cross section and that the circular envelope of the cross-sectional configuration of the reservoir has a diameter of 9 mm to 25 mm.

Seen in the longitudinal direction, the reservoir may have varying cross sections, the circular envelopes having a diameter of 5 mm to 18 mm.

In keeping with another embodiment it is provided for the longitudinal axis of the brush trimming to have such an inclination relative to the longitudinal axis of the stem and thus to the longitudinal axis of the reservoir that the trimming is parallel to a section of the inside wall of the reservoir, resting thereon when the brush is dipped.

Details of the invention will become apparent from the ensuing description of preferred embodiments, taken in conjunction with the drawing.

DESCRIPTION OF THE PREFERRED EMBODIMENTS

Figure 1:
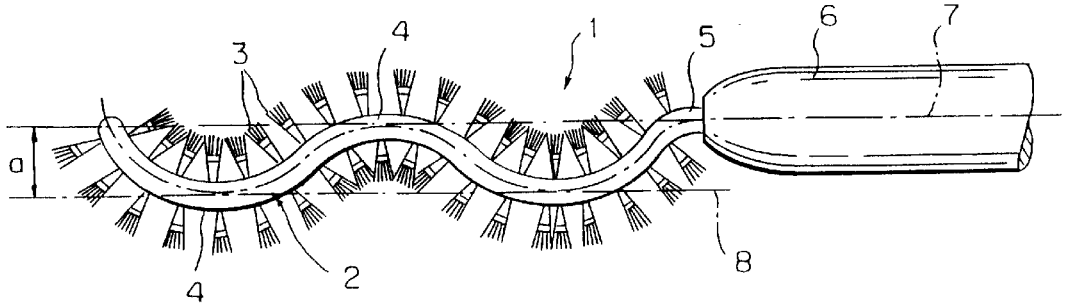
FIG. 1 is an illustration of a first embodiment of a mascara brush according to the invention.

A mascara brush 1 illustrated in the drawing comprises a core 2 which is formed by intertwisted wire sections in a manner known per se and as shown for instance in DE 38 35 843 A1.

Bristles 3 are clamped between the intertwisted wire sections and stand out radially. In the embodiments seen in the drawing, the bristles are bunched, a regular distribution of bristles being provided as a rule along the intertwisted wire sections.

The core 2 is wavy, i.e. it is provided with convexities 4 which extend into different directions.

The core 2 has a free end 5, which is not trimmed with bristles and which is fixed in a stem 6.

The central longitudinal axis 7 of the stem defines a central longitudinal axis of the entire brush 1, the core 2 being offset—downwards in FIG. 1—relative to this central longitudinal axis so that the straight line 8 which connects the concavities has a distance a from the central longitudinal axis 7.

Figure 2:
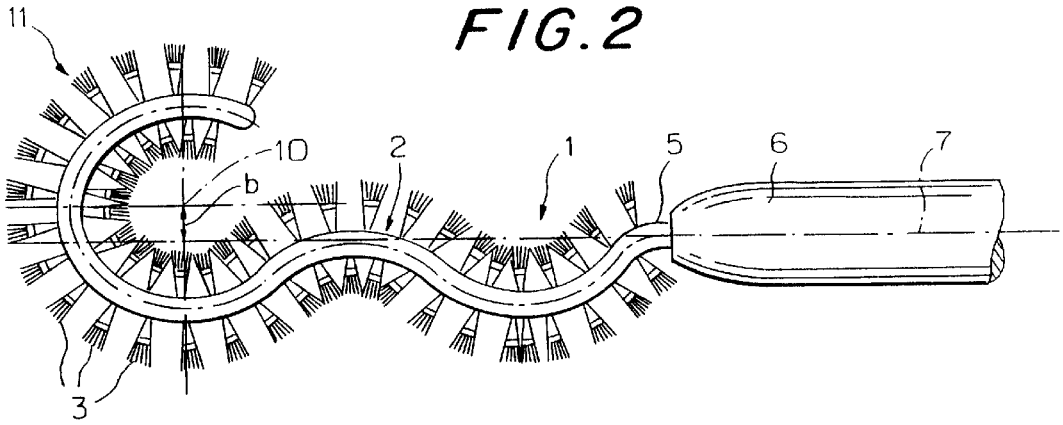
FIG. 2 is an illustration of a second embodiment with an end turned up.

In the embodiment seen in FIG. 2, the end of the core 2 that is turned away from the stem 6 is bent by approximately 200° about a center of curvature 10 which has a distance b from the central longitudinal axis 7 and lies there-above in the drawing so that a semicircular section 11 of bristles which stand out radially is formed.

Figure 3:
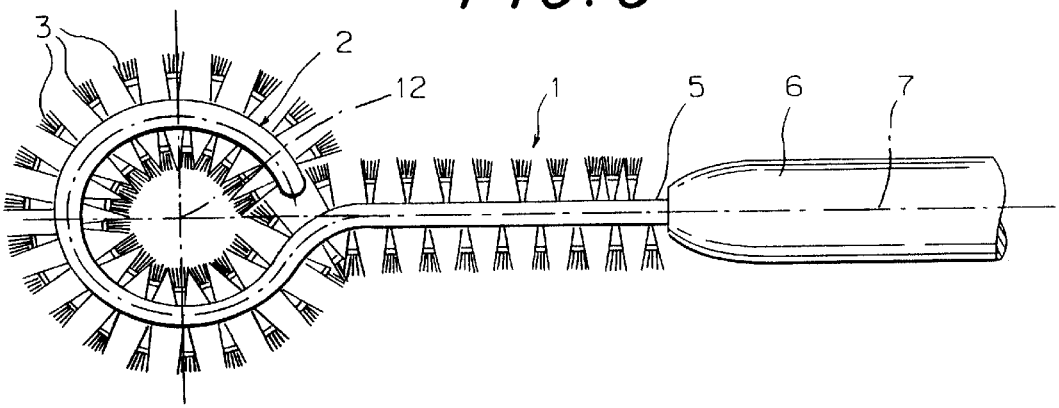
FIG. 3 is an illustration of a modification of the embodiment seen in FIG. 2.

In the embodiment seen in FIG. 3, the center of curvature 12 lies on the central longitudinal axis 7 and the core 2 is bent by approximately 360°.

Figure 4:
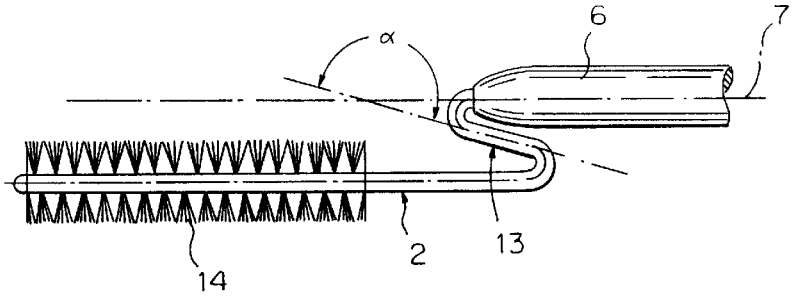
FIGS. 4 to 6 are illustrations of further embodiments with the stem cranked.
Figure 5:
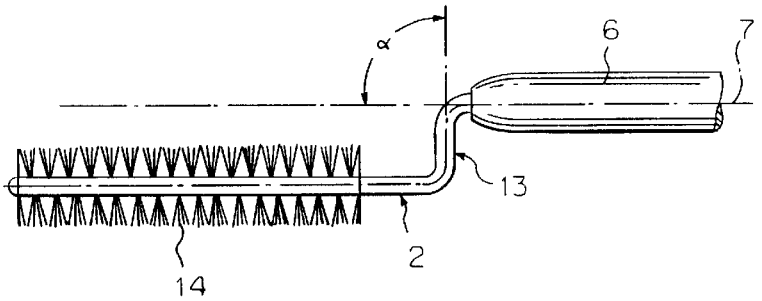
Figure 6:
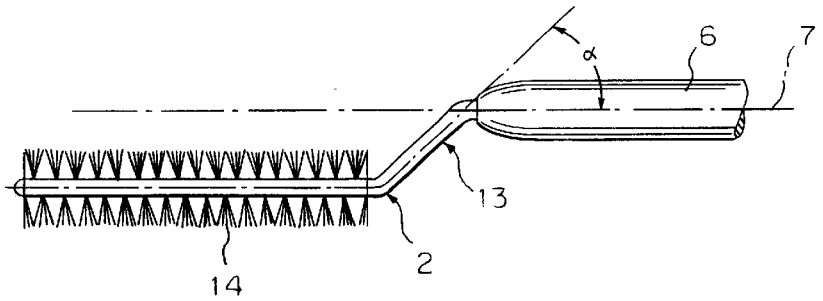

In the embodiments seen in FIGS. 4 to 6, the section 13 of the core 2 between the trimming 14 and the stem 6 is cranked by an obtuse angle α relative to the longitudinal axis 7 of the stem 6 in the embodiment according to FIG. 4, by an angle α of 90° in the embodiment according to FIG. 5 and by an acute angle α in the embodiment according to FIG. 6. In this way, a stirring and stripping effect can be obtained when the cap (not shown), which bears the stem, is screwed on and off.

Figure 7:
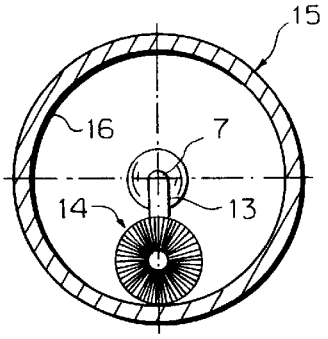
FIG. 7 is a cross-sectional view through the reservoir of a mascara unit according to the invention with the brush inserted.

This can be seen in particular in FIG. 7 which shows a cross section through a reservoir 15 and from which becomes apparent that the bend within the section 13 results in the trimming 14, when dipped, resting on the inside wall 16 of the reservoir 15.

What is claimed is:

1. A mascara unit comprising a brush (1) having a core (2) of intertwisted wire sections between which a plurality of bristles (3) is fixed in place, standing out from the core (2), a free end (5) of the core (2), which is not trimmed with bristles (3), being joined to a stem (6), and a reservoir (15) for the accommodation of mascara into which the brush is dipped having a side wall (16), wherein the brush and reservoir are removably engaged together, and wherein at least part of the bristles of the brush (1) contact the side wall (16) of the reservoir (15) when the brush is engaged in the reservoir and the longitudinal axis (7) of the stem (6) and the reservoir (15) are coaxial.

2. The mascara unit according to claim 1, wherein the core (2) of the brush (1) is laterally offset relative to the longitudinal axis (7) of the stem (6), wherein the central longitudinal axis (14) of the brush and longitudinal axis (7) of stem (6) are parallel.

3. The mascara unit according to claim 1, wherein a trimming formed by the bristles (3) on the free end of the brush stand out in the shape of a semicircle on both sides of the central longitudinal axis of the brush.

4. The mascara unit according to claim 1, wherein the free end of the core (2) is bent backwards in a direction toward the stem (6).

5. The mascara unit according to claim 3, wherein the section (13) of the core (2) between the stem (6) and the trimming (14) is bent by an acute or obtuse angle (α) or by 90° relative to the longitudinal axis (7) of the stem (6), the central longitudinal axis of the brush (14) being parallel to the longitudinal axis (7) of the stem (6).

6. The mascara unit according to claim 1, wherein the reservoir (15) has a diameter ranging between 9.0 mm and 18.0 mm and a length of 25 mm to 80 mm.

7. The mascara unit according to claim 1, wherein the reservoir (15), at least by sections, has a non-circular cross section and the circular envelope of the cross-sectional configuration of the reservoir (15) has a diameter of 9 mm to 25 mm.

8. The mascara unit according to claim 1, wherein seen in the longitudinal direction, the reservoir (15) has varying cross sections, the circular envelopes having a diameter of 5 mm to 18 mm.

9. The mascara unit according to claim 5, wherein the longitudinal axis of the trimming has such an inclination relative to the longitudinal axis of the stem (6) and thus to the longitudinal axis of the reservoir that the trimming is parallel to a section of the inside wall of the reservoir, resting thereon when the brush is engaged in the reservoir.

10. The mascara unit according to claim 6, wherein the longitudinal axis of the trimming has such an inclination relative to the longitudinal axis of the stem (6) and thus to the longitudinal axis of the reservoir that the trimming is parallel to a section of the inside wall of the reservoir, resting thereon when the brush is engaged in the reservoir.

* * * * *